US011065869B2

(12) United States Patent
Matsunaga

(10) Patent No.: US 11,065,869 B2
(45) Date of Patent: Jul. 20, 2021

(54) LIQUID DISCHARGE CONTROL DEVICE AND LIQUID DISCHARGE APPARATUS

(71) Applicant: Ryouhei Matsunaga, Osaka (JP)

(72) Inventor: Ryouhei Matsunaga, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/658,633

(22) Filed: Oct. 21, 2019

(65) Prior Publication Data

US 2020/0156369 A1 May 21, 2020

(30) Foreign Application Priority Data

Nov. 16, 2018 (JP) ..... JP2018-215849

(51) Int. Cl.
*B41J 2/045* (2006.01)

(52) U.S. Cl.
CPC ..... *B41J 2/04588* (2013.01); *B41J 2/0458* (2013.01); *B41J 2/04581* (2013.01)

(58) Field of Classification Search
CPC .. B41J 2/04588; B41J 2/04595; B41J 2/0458; B41J 2/04581
See application file for complete search history.

(56) References Cited

U.S. PATENT DOCUMENTS

2014/0022294 A1* 1/2014 Satou ..... B41J 2/04596 347/10
2014/0327714 A1 11/2014 Iwata et al.
2016/0075132 A1* 3/2016 Kitaoka ..... B41J 2/04588 347/10

FOREIGN PATENT DOCUMENTS

| | | |
|---|---|---|
| JP | 2004-074500 | 3/2004 |
| JP | 2013-075490 | 4/2013 |
| JP | 2014-231218 | 12/2014 |
| JP | 2016-060076 | 4/2016 |

* cited by examiner

*Primary Examiner* — Jason S Uhlenhake
(74) *Attorney, Agent, or Firm* — Harness, Dickey & Pierce, P.L.C.

(57) ABSTRACT

A control device includes circuitry to generate a drive waveform applied to an electromechanical transducer element that changes pressure in a liquid chamber communicating with a nozzle to discharge liquid. The drive waveform includes, in a pulse unit of one discharge cycle, a first discharge pulse waveform including a damping element to damp a vibration of the liquid, and a second discharge pulse waveform subsequent to the first discharge pulse waveform. The circuitry selects at least one of the first and second discharge pulse waveforms in the pulse unit, in accordance with a volume of the liquid to be discharged, to cause the nozzle to discharge different volumes of the liquid. A pulse interval between the first and second discharge pulse waveforms is from $P_{hlm}\times(N\pm 1/8)$ to $P_{hlm}\times(N\pm 1/4)$, where $P_{hlm}$ represents a Helmholtz period of the liquid chamber and N represents an integer of 1 or greater.

16 Claims, 9 Drawing Sheets

LIQUID DISCHARGE CONTROL DEVICE AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-215849, filed on Nov. 16, 2018 in the Japan Patent Office, the entire disclosure of which is hereby incorporated by reference herein.

BACKGROUND

Technical Field

The present disclosure relates to a liquid discharge control device and a liquid discharge apparatus.

Discussion of the Background Art

A conventional liquid discharge apparatus discharges liquid droplets, to generate an image or a shaped object. Such a liquid discharge apparatus uses a technique to selectively discharge a plurality of types of liquid droplets by adjusting the volume of liquid to be discharged, such as large droplets, medium droplets, small droplet, or no discharge.

In a known technique, one discharge pulse is selected to discharge small droplets, two discharge pulses are selected to discharge medium droplets, and three discharge pulses are selected to discharge large droplets. A drive waveform formed with these discharge pulses is supplied so that a plurality of types of liquid droplets with different volumes can be selectively discharged. Further, there is a technique of selecting whether to supply a micro-vibration pulse prior to supply of discharge pulses, thereby changing the volumes of the liquid droplets to be discharged by the discharge pulses.

SUMMARY

An embodiment of this disclosure provides a control device for discharging of a liquid. The control device includes circuitry configured to generate a drive waveform to be applied to an electromechanical transducer element configured to change a pressure in a liquid chamber communicating with a nozzle configured to discharge a liquid. The drive waveform includes a plurality of pulses in a pulse unit of one discharge cycle. The drive waveform includes a first discharge pulse waveform and a second discharge pulse waveform subsequent to the first discharge pulse waveform. The first discharge pulse waveform includes a damping element to damp a vibration of the liquid. Further, the circuitry is configured to select at least one of the first discharge pulse waveform and the second discharge pulse waveform in the pulse unit, in accordance with a volume of the liquid to be discharged, to cause the nozzle to discharge different volumes of the liquid. A pulse interval between the first discharge pulse waveform and the second discharge pulse waveform is in a range of $P_{hlm}\times(N\pm 1/8)$ to $P_{hlm}\times(N\pm 1/4)$, where $P_{hlm}$ represents a Helmholtz period of the liquid chamber and N represents an integer of 1 or greater.

Another embodiment provides a liquid discharge apparatus that includes a nozzle configured to discharge a liquid, a liquid chamber communicating with the nozzle, an electromechanical transducer element configured to change a pressure in the liquid chamber, and the circuitry described above.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
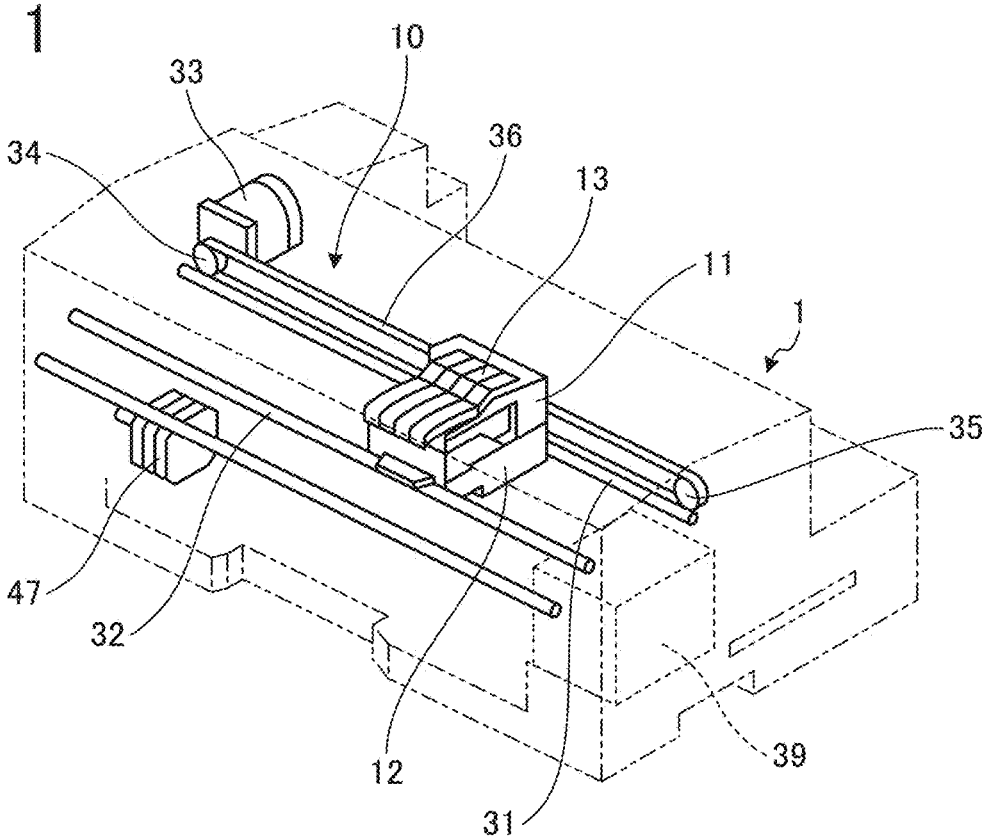
FIG. 1 is a diagram illustrating an example of the overall structure of a liquid discharge apparatus according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

The following is a detailed description of embodiments of a control device and a liquid discharge apparatus according to the present disclosure, with reference to the drawings.

Note that the present invention is not limited by the embodiments described below, and the components in the embodiments described below include components that can be easily conceived by those skilled in the art, components that are substantially the same, and components that fall within a so-called equivalent range. Furthermore, the components can be omitted, replaced, or modified in various manners, without departing from the scope of the embodiments described below.

Overall Structure of a Liquid Discharge Apparatus

Figure 2:
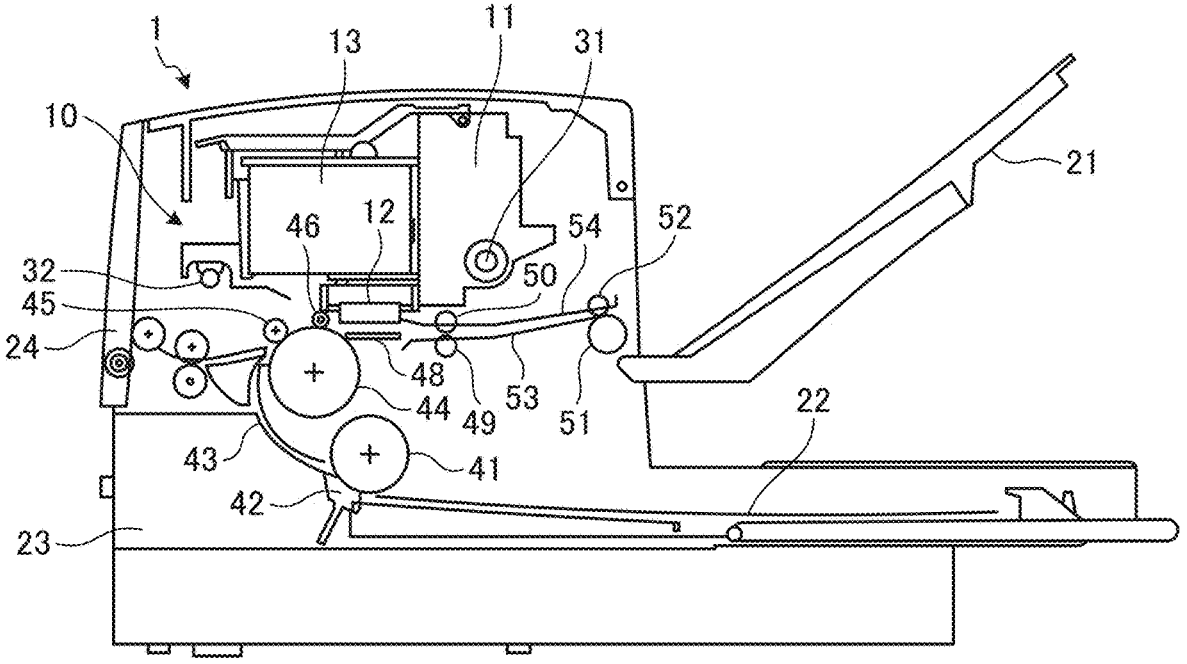
FIG. 2 is a diagram illustrating an example of a cross-section of the structure of the liquid discharge apparatus illustrated in FIG. 1.

FIG. 1 is a diagram illustrating an example of the overall structure of a liquid discharge apparatus 1 according to this embodiment. FIG. 2 is a diagram illustrating an example of a cross-section of the structure of the liquid discharge apparatus 1 according to this embodiment. Referring to FIGS. 1 and 2, the general arrangement of the liquid discharge apparatus 1 according to this embodiment is described.

As illustrated in FIGS. 1 and 2, the liquid discharge apparatus 1 according to this embodiment has a printing mechanism 10 that includes: a carriage 11 movable in the main scanning direction; a recording head 12 that is mounted in the carriage 11 and discharges ink; and ink cartridges 13 that supply ink to the recording head 12. The liquid discharge apparatus 1 also includes: a sheet feeding tray 23 that is capable of loading a large number of paper sheets 22 from the front side in a lower part, and can be detachably mounted in the liquid discharge apparatus 1; a sheet feeding tray 24 that can be opened and closed to manually feed the paper sheets 22; and a sheet ejection tray 21 for ejecting the paper sheets 22 fed from the sheet feeding tray 23 or the sheet feeding tray 24 to the rear side after a predetermined image is printed.

The carriage 11 is slidably held in the main scanning direction by a main guide rod 31 and a sub guide rod 32 that are guide members laterally extending in the main scanning direction. The recording head 12 is a liquid discharge head that is mounted in the carriage 11, discharges ink droplets of the respective colors of yellow (Y), cyan (C), magenta (M), and black (BK), and has a plurality of ink discharge ports (nozzles) that is arranged in a direction intersecting the main scanning direction and are designed so that the discharge direction is a downward direction.

Ink and ink droplets are examples of a liquid. The liquid to be discharged from the nozzles is not necessarily ink.

The ink cartridges 13 are replaceable and are mounted in the carriage 11, to supply the ink of each color to the recording head 12. The ink cartridges 13 each has an air port communicating with the air formed above each corresponding ink cartridges 13, a supply port that supplies ink to the recording head 12 disposed below each corresponding ink cartridges 13, and a porous member filled with the ink stored in each corresponding ink cartridge 13. This porous member maintains the ink to be supplied to the recording head 12 at a slightly negative pressure by capillary force. The recording head 12 can be formed with a plurality of heads that discharges ink droplets of the respective colors, or can be formed with a single head having a plurality of nozzles that discharges ink droplets of the respective colors.

The liquid discharge apparatus 1 also includes: a main scanning motor 33; a driving pulley 34 that is rotationally driven by rotation of the main scanning motor 33; a driven pulley paired with the driving pulley 34; and a timing belt 36 that is stretched between the driving pulley 34 and the driven pulley 35. The carriage 11 is secured to the timing belt 36, and reciprocates in the main scanning direction with the forward and backward rotation of the main scanning motor 33.

The liquid discharge apparatus 1 further includes a sheet feeding roller 41, a friction pad 42, a guide member 43, a conveyance roller 44, a conveyance small roller 45, a top end small roller 46, and a sub scanning motor 47.

The sheet feeding roller 41 and the friction pad 42 separate and supply paper sheets 22 from the sheet feeding tray 23, to convey the paper sheets 22 set in the sheet feeding tray 23 to the lower side of the recording head 12. The guide member 43 guides each paper sheet 22 separated and supplied by the sheet feeding roller 41 and the friction pad 42 to the conveyance roller 44. The conveyance roller 44 reverses the fed paper sheet 22, and conveys the paper sheet 22 to the lower side of the recording head 12. The conveyance small roller 45 presses the paper sheet 22 against the peripheral surface of the conveyance roller 44. The top end small roller 46 defines the delivery angle of the paper sheet 22 conveyed from the conveyance roller 44 to the lower side of the recording head 12. The sub scanning motor 47 rotationally drives the sheet feeding roller 41 via a gear train.

The liquid discharge apparatus 1 also includes a print receiving unit 48, a conveyance small roller 49, a spur 50, a sheet ejection roller 51, a spur 52, a guide member 53, and a guide member 54.

The print receiving unit 48 is a guide member that guides the paper sheet 22 delivered from the sheet feeding roller 41 in accordance with the movement range of the carriage 11 in the main scanning direction on the lower side of the recording head 12. The conveyance small roller 49 and the spur 50 are disposed on the downstream side of the print receiving unit 48 in the sheet conveyance direction, and are members that are rotationally driven to feed the paper sheet 22 in the sheet ejection direction. The sheet ejection roller 51 and the spur 52 are members that are rotationally driven to deliver the paper sheet 22 delivered by the conveyance small roller 49 and the spur 50, to the sheet ejection tray 21. The guide members 53 and 54 are members that form a sheet ejection path.

The liquid discharge apparatus 1 further includes a recovery device 39 that is disposed at a position outside the recording region at the end of the carriage 11 in the moving direction thereof, and is designed to recover discharge defects of the recording head 12. The recovery device 39 includes a capping unit, a suction device, and a cleaning unit. The carriage 11 moves toward the recovery device 39 while standing by for printing, and the recording head 12 is capped by the capping unit, so that the wet state of the nozzle unit is maintained. Thus, discharge defects due to drying of ink are reduced. Further, the recording head 12 discharges ink not related to recording, to make the viscosity of the ink in all the nozzles constant and maintain stable discharging performance.

In a case where the recording head 12 has a discharge defect, the capping unit seals the nozzles, the suction device sucks air bubbles and the like together with ink through a tube, and the cleaning unit removes the ink and the dust or the like adhering to the portions in the vicinities of the nozzles. Thus, the discharge defect is recovered. Further, the sucked ink is discharged into a waste ink reservoir installed at a lower portion of the main body of the liquid discharge apparatus 1, and is absorbed and held by an ink absorber inside the waste ink reservoir.

At the time of recording (printing), the liquid discharge apparatus 1 described above drives the recording head 12 in accordance with image data while moving the carriage 11, to discharge ink onto a stopped paper sheet 22 and perform recording of one line. After conveying the paper sheet 22 in the sub-scanning direction by a predetermined amount, the liquid discharge apparatus 1 performs recording of the next line. The liquid discharge apparatus 1 also receives a recording end signal that is a signal indicating that the bottom edge of the paper sheet 22 has reached the recording region. The liquid discharge apparatus 1 then ends the recording operation, and ejects the paper sheet 22.

Example Configuration of the Recording Head

Next, an example configuration of the recording head 12 is described.

Figure 3:
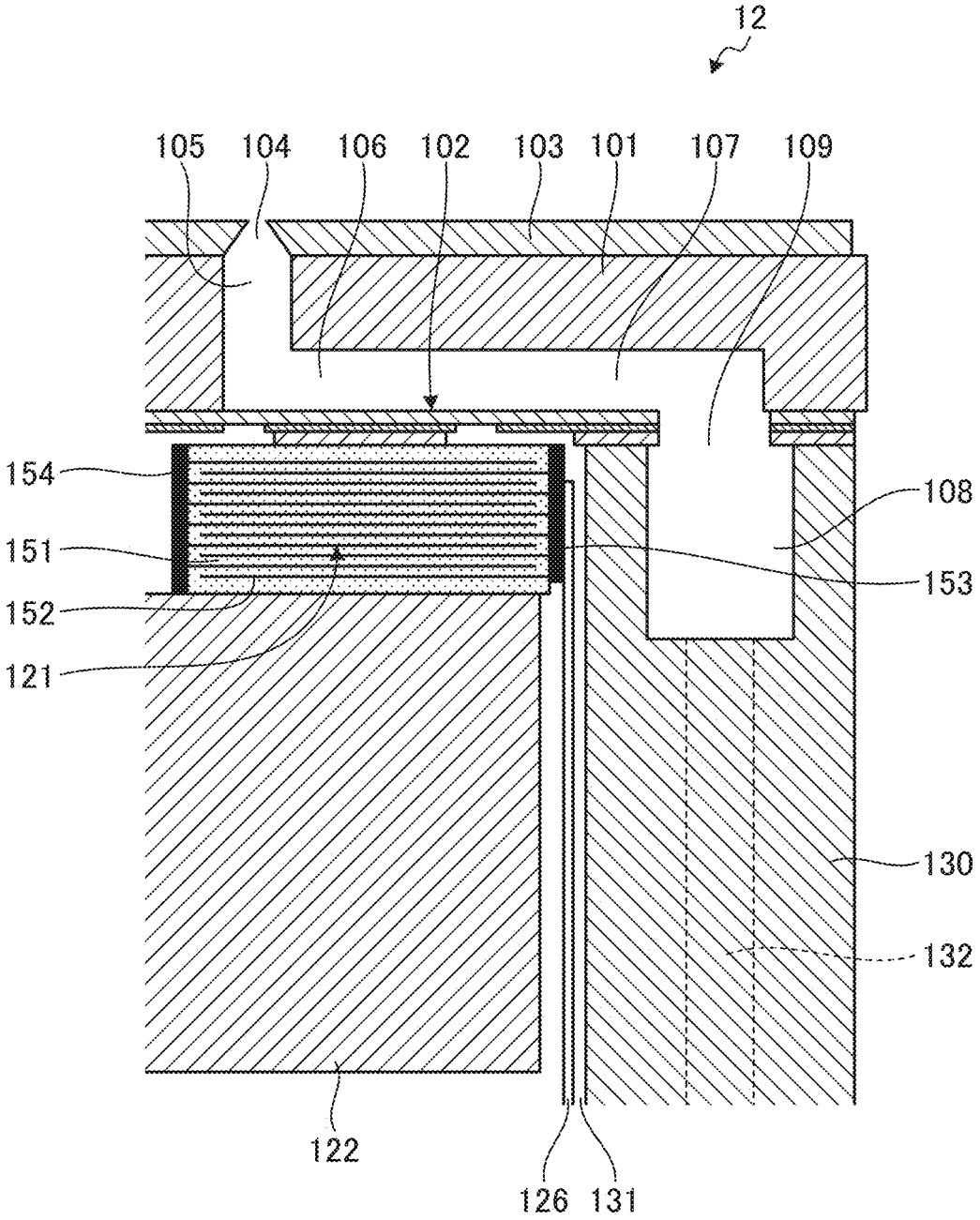
FIG. 3 is an example of a cross-sectional view of a recording head according to an embodiment, taken in a longitudinal direction of liquid chambers.
Figure 4:
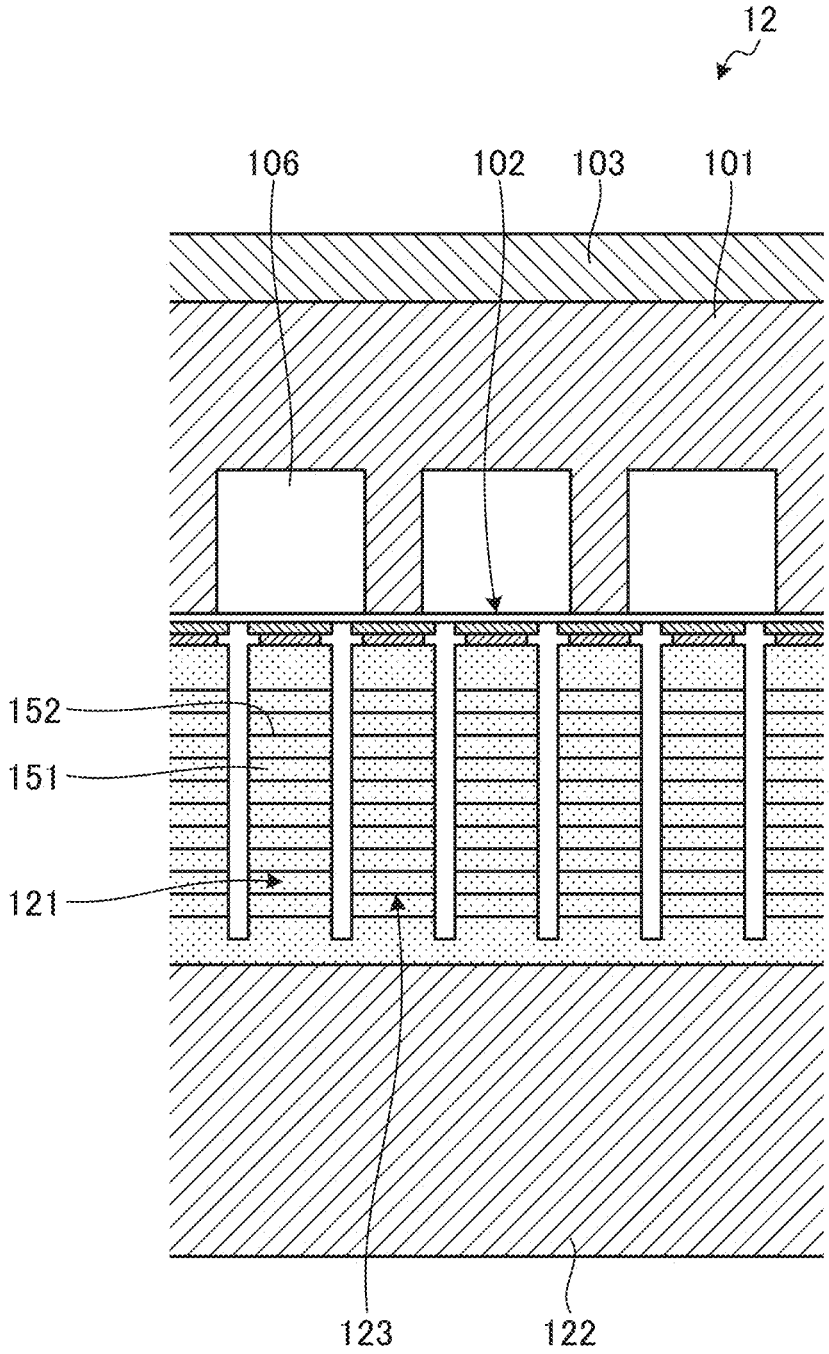
FIG. 4 is an example of a cross-sectional view of the recording head illustrated in FIG. 3, taken in a short direction of liquid chambers.

FIG. 3 is an example of a cross-sectional view of the recording head 12 taken in a longitudinal direction of the liquid chambers. FIG. 4 is an example of a cross-sectional view of the recording head 12 taken in a transverse direction of the liquid chambers.

The recording head 12 of this embodiment includes a channel substrate 101 formed by performing anisotropic etching on a single-crystal silicon substrate; a diaphragm 102 formed with electroformed nickel joined to the lower surface of the channel substrate 101; and a nozzle plate 103 joined to the upper surface of the channel substrate 101. The channel substrate 101, the diaphragm 102, and the nozzle plate 103 are joined and stacked, to form the recording head 12. With these components, nozzle communication channels 105, liquid chambers 106, ink supply ports 109, and the like are formed. The nozzle communication channel 105 are channels with which the nozzles 104 that discharge liquid droplets (ink droplets) communicate. The liquid chambers 106 are portions for generating pressure. The ink supply ports 109 are portions communicating with a common liquid chamber 108 for supplying ink to the liquid chambers 106 through fluid restrictors (supply channels) 107.

Piezoelectric elements 121 are provided in the recording head 12. The piezoelectric elements 121 are an example of electromechanical transducer elements. When voltage is applied to the electromechanical transducer elements, the electromechanical transducer elements change the pressure in the liquid chambers 106 communicating with the nozzles 104. The piezoelectric elements 121 are pressure generator units (actuator units) for deforming the diaphragm 102 to apply pressure to the ink in the liquid chambers 106. For example, the piezoelectric elements 121 are two rows of stacked elements. In FIG. 3, one row of piezoelectric elements 121 is illustrated as an example.

The recording head 12 also includes a base substrate 122 onto which the piezoelectric elements 121 are bonded and secured. Further, support pillar portions 123 are provided between the piezoelectric elements 121. The support pillar portions 123 are portions formed at the same time as the piezoelectric elements 121 through divisional processing of the piezoelectric element material. However, any drive voltage is not applied to the support pillar portions 123, and therefore, the support pillar portions 123 serve simply as support pillars. Further, a flexible printed circuit (FPC) cable 126 on which a drive circuit (a drive integrated circuit (IC)) is mounted is connected to each piezoelectric element 121.

The peripheral portion of the diaphragm 102 is joined to a frame member 130. A penetrating portion 131, a recess to be the common liquid chamber 108, and an ink supply hole 132 are formed in the frame member 130. The penetrating portion 131 is a portion for accommodating an actuator unit formed with the piezoelectric elements 121, the base substrate 122, and the like. The ink supply hole 132 is a portion for supplying ink to the common liquid chamber 108 from outside. The frame member 130 is formed by injection molding of thermosetting resin such as epoxy resin or polyphenylene sulfite, for example.

As for the channel substrate 101, a single-crystal silicon substrate having a crystal plane orientation, for example, is subjected to anisotropic etching using an alkaline etching solution such as a potassium hydroxide aqueous solution (KOH), so that the recesses and holes to be the nozzle communication channels 105 and the liquid chambers 106 are formed. The channel substrate 101 is not necessarily formed with a single-crystal silicon substrate, and some other stainless steel substrate, a photosensitive resin, or the like can be used.

The diaphragm 102 is formed with a metal plate made of nickel. The diaphragm 102 is manufactured by an electroforming method, for example. As for the material of the diaphragm 102, it is also possible to use some other metal plate, a joined member formed with a metal plate and a resin plate, or the like. The piezoelectric elements 121 and the support pillar portions 123 are bonded to the diaphragm 102 with an adhesive, and the frame member 130 is further bonded to the diaphragm 102 with an adhesive.

In the nozzle plate 103, nozzles 104 each having a diameter of 10 to 30 μm are formed for the respective liquid chambers 106, and are bonded to the channel substrate 101 with an adhesive. The nozzle plate 103 has a water repellent layer formed as an outermost surface via a predetermined layer on the surface of the nozzle forming member formed with a metal member.

The piezoelectric elements 121 are stacked piezoelectric elements (PZT in this case) in which piezoelectric materials 151 and internal electrodes 152 are alternately stacked. An individual electrode 153 and a common electrode 154 are connected to the respective internal electrodes 152 drawn to alternately different end faces of the piezoelectric elements 121. In this embodiment, changes in the piezoelectric direction of the piezoelectric elements 121 are used to apply pressure to the ink in the liquid chambers 106. Alternatively, a row of piezoelectric elements 121 can be provided in a single base substrate 122.

In the recording head 12 designed in this manner, the voltage to be applied to the piezoelectric elements 121 is lowered from a first potential so that the piezoelectric elements 121 contract, and the diaphragm 102 descends to increase the volume of the liquid chambers 106. As a result, the ink flows into the liquid chambers 106. The first potential is a predetermined reference potential. After that, the voltage to be applied to the piezoelectric elements 121 is made higher, to extend the piezoelectric elements 121 in the stacking direction. The diaphragm 102 is then deformed toward the nozzles 104, to reduce the volume/size of the liquid chambers 106. As a result, pressure is applied to the ink in the liquid chambers 106, and ink droplets are discharged (ejected) from the nozzles 104.

The voltage to be applied to the piezoelectric elements 121 is then returned to the first potential, so that the diaphragm 102 is restored to the initial position, and the liquid chambers 106 expand to generate a negative pressure. At this stage, the liquid chambers 106 are filled with ink from the common liquid chamber 108. After the vibration of the meniscus surfaces of the nozzles 104 is attenuated and stabilized, the operation for the next droplet discharge is started.

The method of driving the recording head 12 is not limited to the above described example (pull-push discharge), but pulling discharge and pushing discharge can be performed depending on how the drive waveform is generated.

Example Hardware Configuration of the Liquid Discharge Apparatus

Next, an example hardware configuration of the liquid discharge apparatus 1 of this embodiment is described.

Figure 5:
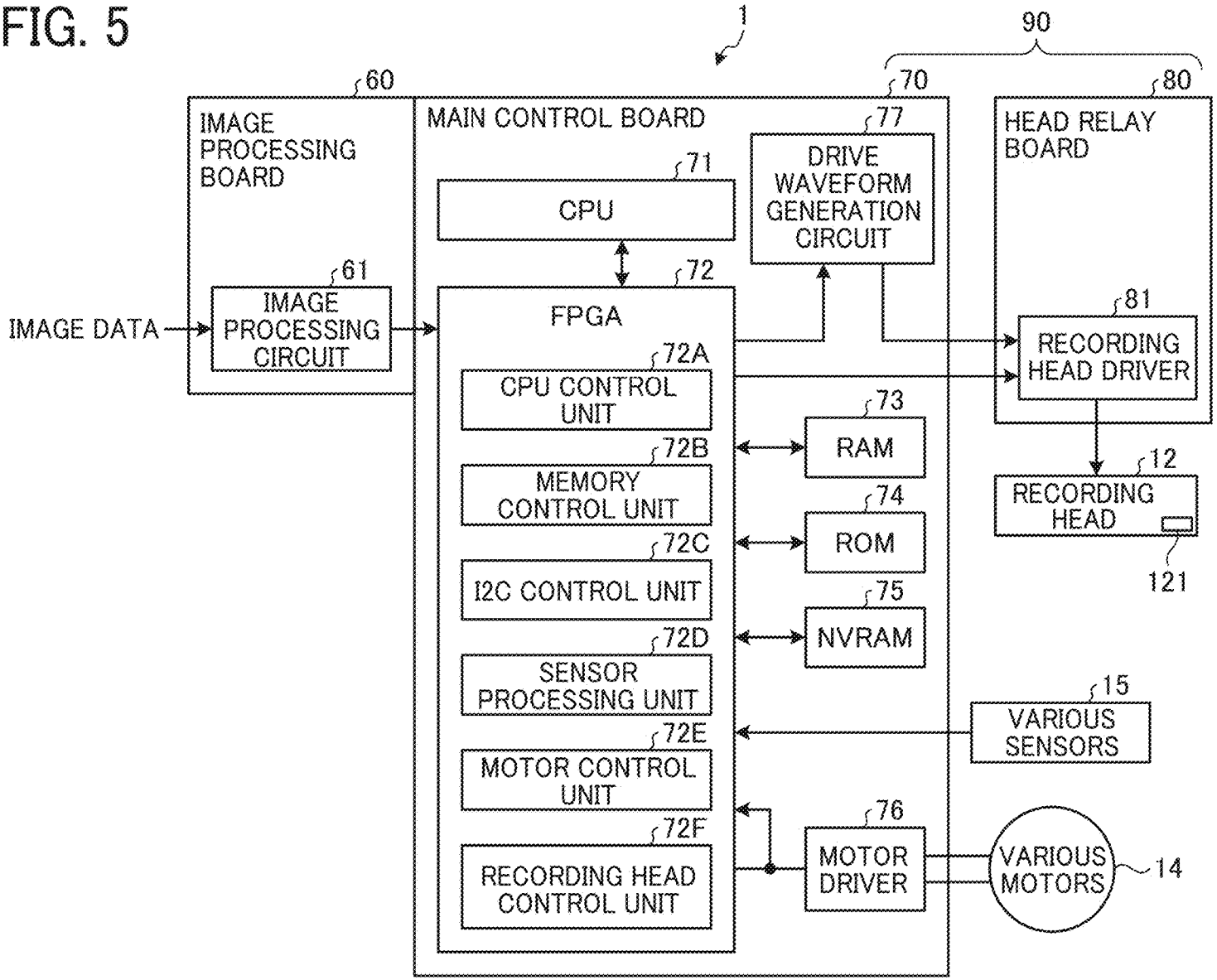
FIG. 5 is a diagram illustrating an example hardware configuration of the liquid discharge apparatus illustrated in FIG. 1.

FIG. 5 is a diagram illustrating an example hardware configuration of the liquid discharge apparatus 1 according to this embodiment.

The liquid discharge apparatus 1 according to this embodiment includes an image processing board 60, a main control board 70, and a head relay board 80. The main control board 70 and the head relay board 80 correspond to a control device 90 of the liquid discharge apparatus 1.

The image processing board 60 is a circuit board that performs image processing on input image data. The image processing board 60 includes an image processing circuit 61 that performs image processing on image data.

Based on the image data subjected to image processing, the main control board 70 generates the drive waveform for driving the piezoelectric elements 121 that discharge ink droplets for performing printing on a paper sheet 22, determines a bias voltage, and issues a command to apply the voltage for driving the piezoelectric elements 121 to the head relay board 80.

The main control board 70 includes a central processing unit (CPU) 71, a field-programmable gate array (FPGA) 72, a random access memory (RAM) 73, a read only memory (ROM) 74, a non-volatile RAM (NVRAM) 75, a motor driver 76, and a drive waveform generation circuit 77.

The CPU 71 is an arithmetic device that controls the overall operation of the liquid discharge apparatus 1. The CPU 71 uses the RAM 73 as a work area, and executes various kinds of control programs stored in the ROM 74, to output control commands for controlling various kinds of operations in the liquid discharge apparatus 1. While communicating with the FPGA 72, The CPU 71 controls various kinds of operations in the liquid discharge apparatus 1 in cooperation with the FPGA 72.

The FPGA 72 is an integrated circuit that controls various kinds of operations in the liquid discharge apparatus 1 in cooperation with the CPU 71. The FPGA 72 includes a CPU control unit 72A, a memory control unit 72B, an inter-integrated circuit (I2C) control unit 72C, a sensor processing unit 72D, a motor control unit 72E, and a recording head control unit 72F.

The CPU control unit 72A has a function to communicate with the CPU 71. The memory control unit 72B has a function to access the RAM 73 and the ROM 74. The I2C control unit 72C has a function to access the NVRAM 75.

The sensor processing unit 72D processes sensor signals from various sensors 15. The various sensors 15 are a generic term for sensors that detect various states in the liquid discharge apparatus 1. The various sensors 15 include an encoder sensor, a sheet sensor that detects passage of a paper sheet (a recording sheet), a cover sensor that detects opening/closing of a cover member, a temperature and humidity sensor that detects the environmental temperature and humidity, a sheet securing lever sensor that detects an operation state of a lever for securing a paper sheet, and a remaining amount detecting sensor that detects the remaining amount of the ink in the cartridge. Further, analog sensor signals that are output from the various sensors 15 are converted into digital signals by an analog-to-digital (AD) converter mounted on the main control board 70 or the like, and are input to the FPGA 72, for example.

The motor control unit 72E controls various motors 14. The various motors 14 are a general term for motors included in the liquid discharge apparatus 1. The various motors 14 include the main scanning motor 33 for operating the carriage 11, the sub scanning motor 47 for conveying a paper sheet 22 in the sub-scanning direction, and a sheet feeding motor for feeding paper sheets 22.

An example of operation control to be performed on the main scanning motor 33 is now described. More specifically, a specific example of control to be performed by cooperation between the CPU 71 and the motor control unit 72E of the FPGA 72 is now described.

First, the CPU 71 instructs the motor control unit 72E to start operating the main scanning motor 33, and notifies the motor control unit 72E of the moving velocity and the moving distance of the carriage 11. Upon receipt of this instruction, the motor control unit 72E generates a drive profile based on the information about the moving velocity and the moving distance sent from the CPU 71, and calculates and outputs a pulse width modulation (PWM) command value to the motor driver 76, while performing comparison with an encoder value of an encoder sensor acquired from the sensor processing unit 72D.

After ending the predetermined operation, the motor control unit 72E notifies the CPU 71 of the end of the operation. Although an example in which the motor control unit 72E generates a drive profile has been described, the CPU 71 may generate a drive profile and issues an instruction to the motor control unit 72E. The CPU 71 also performs counting of the number of printed sheets, counting of the number of scanning operation by the main scanning motor 33, and the like.

The recording head control unit 72F sends the head drive data stored in the ROM 74, a discharge synchronization signal LINE, and a discharge timing signal CHANGE to the drive waveform generation circuit 77, and causes the drive waveform generation circuit 77 to generate a drive waveform. The drive waveform generated by the drive waveform generation circuit 77 is output to a recording head driver 81 mounted on the head relay board 80.

Figure 6:
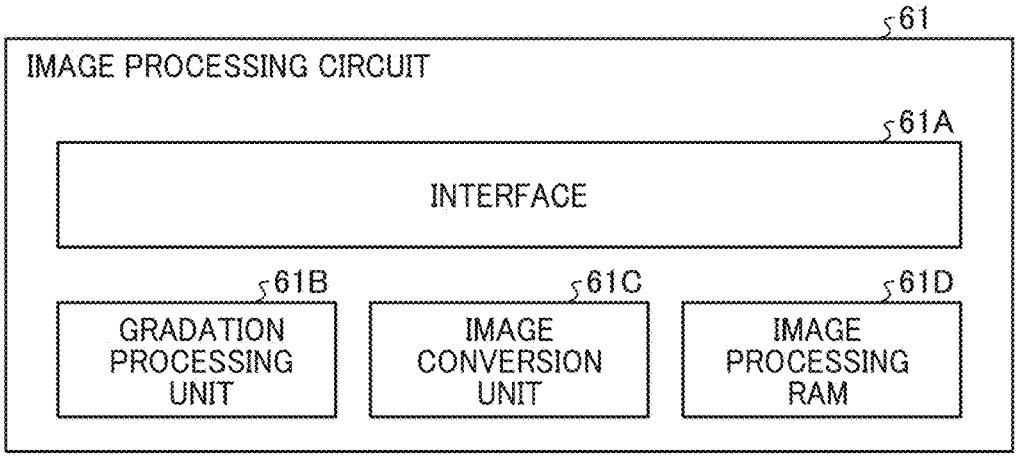
FIG. 6 is a block diagram illustrating an example functional configuration of an image processing circuit illustrated in FIG. 5.

FIG. 6 is a block diagram illustrating an example functional configuration of the image processing circuit 61 of the image processing board 60.

The image processing circuit 61 performs gradation processing, an image conversion process, and the like on received image data, to convert the received image data into image data in a format that can be processed by the recording head control unit 72F. The image processing circuit 61 then outputs the converted image data to the recording head control unit 72F of the main control board 70.

Specifically, the image processing circuit 61 includes an interface 61A, a gradation processing unit 61B, an image conversion unit 61C, and an image processing RAM 61D.

The interface 61A is an input unit of image data, and is a communication interface with the CPU 71 and the FPGA 72. The gradation processing unit 61B performs gradation processing on the received multivalued image data, to convert the multivalued image data into small-value image data. The small-value image data is image data at the gradation level equal to the type of liquid droplets (large droplets, medium droplets, or small droplets) to be discharged by the recording head 12. The gradation processing unit 61B then holds at least one band of the converted image data in the image processing RAM 61D.

One band of image data refers to image data corresponding to the maximum width in the sub-scanning direction that can be recorded by the recording head 12 in one scanning operation in the main-scanning direction X.

The image conversion unit 61C performs image data conversion on one band of image data in the image processing RAM 61D by the image unit to be output in one scanning operation in the main-scanning direction X. This conversion is performed depending on the configuration of the recording head 12, in accordance with information about the sequence of printing and the print width (=the sub-scanning width of image recording per one scanning operation) received from the CPU 71 via the interface 61A.

The sequence of printing and the print width can be one-pass printing in which an image is formed by one main scanning operation on a recording medium, or can be multi-pass printing in which an image is formed by main scanning operations on the same region on a paper sheet 22 with the same nozzles or different nozzles. Alternatively, heads can be aligned in the main-scanning direction, and printing can be performed on the same region with different nozzles. These recording methods can be used in combination as appropriate. The print width indicates the width in the sub-scanning direction Y of an image recorded by the recording head 12 performing a scanning operation once (one scan) in the main-scanning direction X. In this embodiment, the print width is set by the CPU 71.

The image conversion unit 61C outputs the converted image data to an image recording unit via the interface 61A.

The functions of the image processing circuit 61 can be implemented as the functions of hardware such as an FPGA or an application-specific integrated circuit (ASIC), or can be implemented by an image processing program stored in a storage device in the image processing circuit 61. Alternatively, the functions of the image processing circuit 61 can be implemented not in the liquid discharge apparatus 1, but by software installed in a computer.

Figure 7:
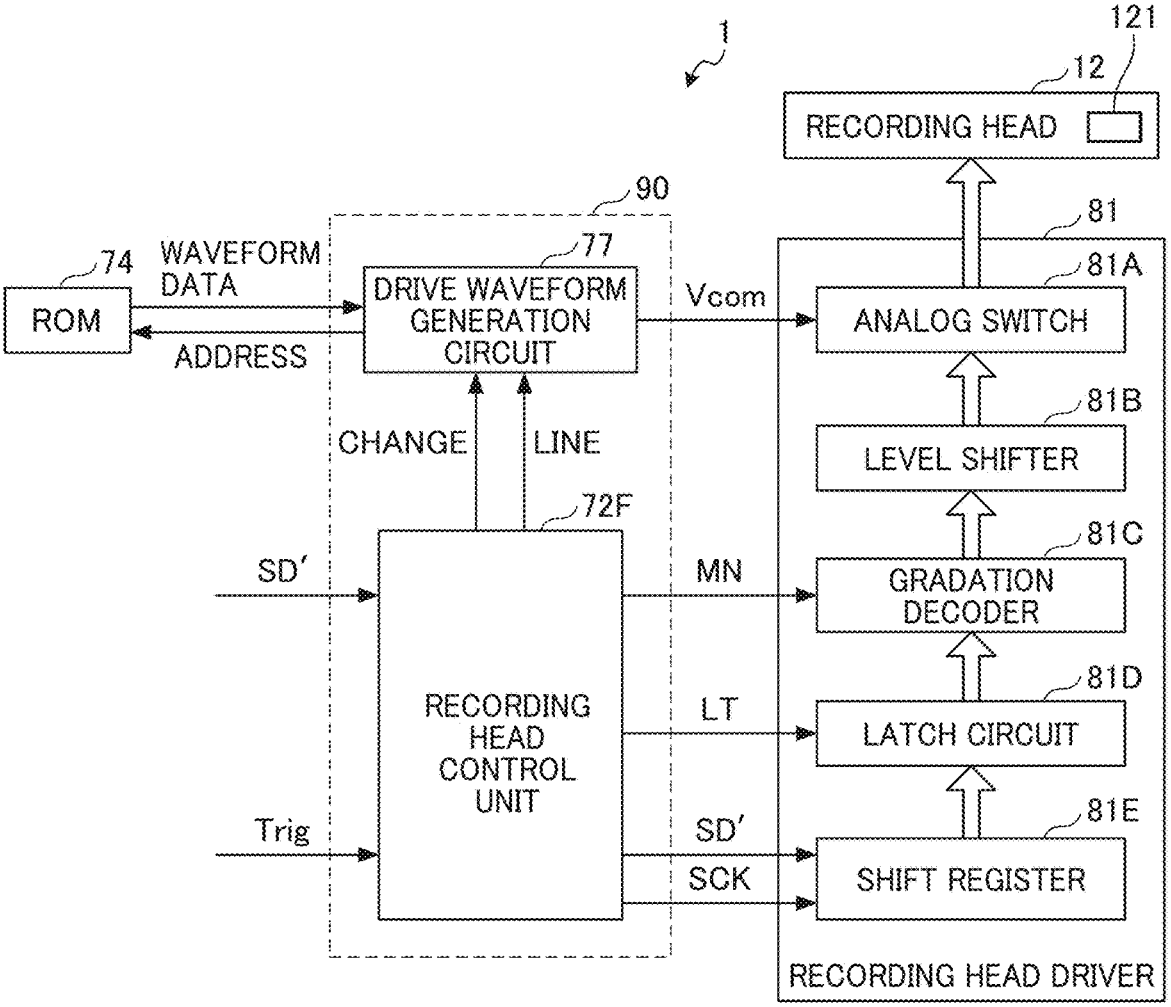
FIG. 7 is a diagram for explaining the hardware configuration of the relevant components of the liquid discharge apparatus illustrated in FIG. 1.

Referring now to FIG. 7, the hardware configuration of the relevant components of the liquid discharge apparatus 1 is further described. FIG. 7 is a diagram illustrating an example hardware configuration of the relevant components of the liquid discharge apparatus 1. In FIG. 7, the drive waveform generation circuit 77 and the recording head control unit 72F are illustrated as components included in a control device 90.

When the recording head control unit 72F receives a trigger signal Trig that triggers the timing of discharge, the recording head control unit 72F outputs a discharge synchronization signal LINE that triggers generation of a drive waveform, to the drive waveform generation circuit 77. The recording head control unit 72F further outputs a discharge timing signal CHANGE indicating the amount of delay from the discharge synchronization signal LINE, to the drive waveform generation circuit 77.

The drive waveform generation circuit 77 is an example of a drive waveform generation unit. The drive waveform generation circuit 77 is not necessarily formed with a circuit, but can be formed with software. In this embodiment, a case where the drive waveform generation circuit 77 is a circuit is described as an example.

Using waveform data read from the ROM 74, the drive waveform generation circuit 77 generates a drive waveform Vcom at the timing based on the discharge synchronization signal LINE and the discharge timing signal CHANGE. In this embodiment, the drive waveform Vcom is a signal that includes a plurality of discharge pulses in a pulse unit that is one discharge cycle, and is represented by a waveform. The drive waveform to be used in this embodiment will be described later in detail.

The recording head control unit 72F also receives image data SD' subjected to image processing from the image processing circuit 61 (see FIG. 5), and, based on the image data SD', generates a mask control signal MN for selecting a discharge pulse for each pulse unit in the drive waveform Vcom in accordance with the size of the ink droplets to be discharged from the respective nozzles of the recording head 12. The mask control signal MN is a signal of the timing synchronized with the discharge timing signal CHANGE. The recording head control unit 72F then transmits the image data SD', a synchronous clock signal SCK, a latch signal LT serving as an instruction to latch the image data SD', and the generated mask control signal MN to the recording head driver 81.

The recording head driver 81 is an example of a selection unit. The recording head driver 81 selects, for each pulse unit, a discharge pulse included in the drive waveform given from the drive waveform generation circuit 77, based on serially-input image data corresponding to one line of the recording head 12.

The recording head driver 81 applies a drive waveform including the pulse unit containing the selected discharge pulse to the piezoelectric elements 121, which are an example of an electromechanical transducer element. By doing so, the recording head driver 81 drives the piezoelectric elements 121 of the recording head 12. In this embodiment, the recording head driver 81 selects a discharge pulse included in a pulse unit in accordance with the volume of liquid to be discharged (large droplets, medium droplets, small droplets, or no discharge, for example). In this manner, the recording head driver 81 can change the volume of liquid to be discharged from the nozzles 104 by application of a pulse unit. For example, the recording head driver 81 can select one or more types of liquid droplets having different volumes, such as large droplets, medium droplets, small droplets, and no discharge.

Specifically, the recording head driver 81 includes a shift register 81E, a latch circuit 81D, a gradation decoder 81C, a level shifter 81B, and an analog switch 81A.

The shift register 81E receives the image data SD' and the synchronous clock signal SCK transmitted from the recording head control unit 72F. The latch circuit 81D latches each registration value of the shift register 81E with the latch signal LT transmitted from the recording head control unit 72F.

The gradation decoder 81C decodes the value (the image data SD') latched by the latch circuit 81D and the mask control signal MN, to output a logic level voltage signal. The level shifter 81B performs level conversion on the logic level voltage signal of the gradation decoder 81C to a level at which the analog switch 81A can operate.

The analog switch 81A is a switch that is turned on and off by the logic level voltage signal of the gradation decoder 81C that is supplied via the level shifter 81B. The analog switch 81A is provided for each of the nozzles of the recording head 12, and is connected to individual electrodes 153 of the piezoelectric elements 121 corresponding to the respective nozzles. The analog switch 81A also receives the drive waveform Vcom from the drive waveform generation circuit 77. Further, the timing of the mask control signal MN is synchronized with the timing of the drive waveform Vcom, as described above.

Accordingly, the analog switch 81A switches on/off at an appropriate timing in accordance with the logic level voltage signal of the gradation decoder 81C supplied via the level shifter 81B, to select a discharge pulse contained in each pulse unit included in the drive waveform Vcom, for each of the piezoelectric elements 121 corresponding to the respective nozzles. As a result, a voltage having the drive waveform indicated by the pulse unit formed with the selected discharge pulse is applied to the individual electrodes 153 corresponding to the piezoelectric elements 121, so that the size of the ink droplets to be discharged from the nozzles is controlled.

Note that the configuration of the liquid discharge apparatus 1 illustrated in FIGS. 5 through 7 is an example, and the liquid discharge apparatus 1 does not necessarily include all the components illustrated in FIGS. 5 through 7, or may include some other components.

Drive Waveform

Next, the drive waveform that the drive waveform generation circuit 77 outputs to the recording head driver 81 is described in detail. Note that the drive waveform that the drive waveform generation circuit 77 outputs to the recording head driver 81 corresponds to the drive waveform Vcom.

The drive waveform generation circuit 77 generates a drive waveform including a plurality of discharge pulses in a pulse unit of one discharge cycle.

One discharge cycle is a cycle of a drive waveform to be applied to the piezoelectric elements 121 to discharge one liquid droplet to be discharged from the nozzles 104. The drive waveform is formed with one or more pulse units. In other words, the waveform in each period after division that divides a drive waveform by one discharge cycle is equivalent to a pulse unit.

Figure 8:
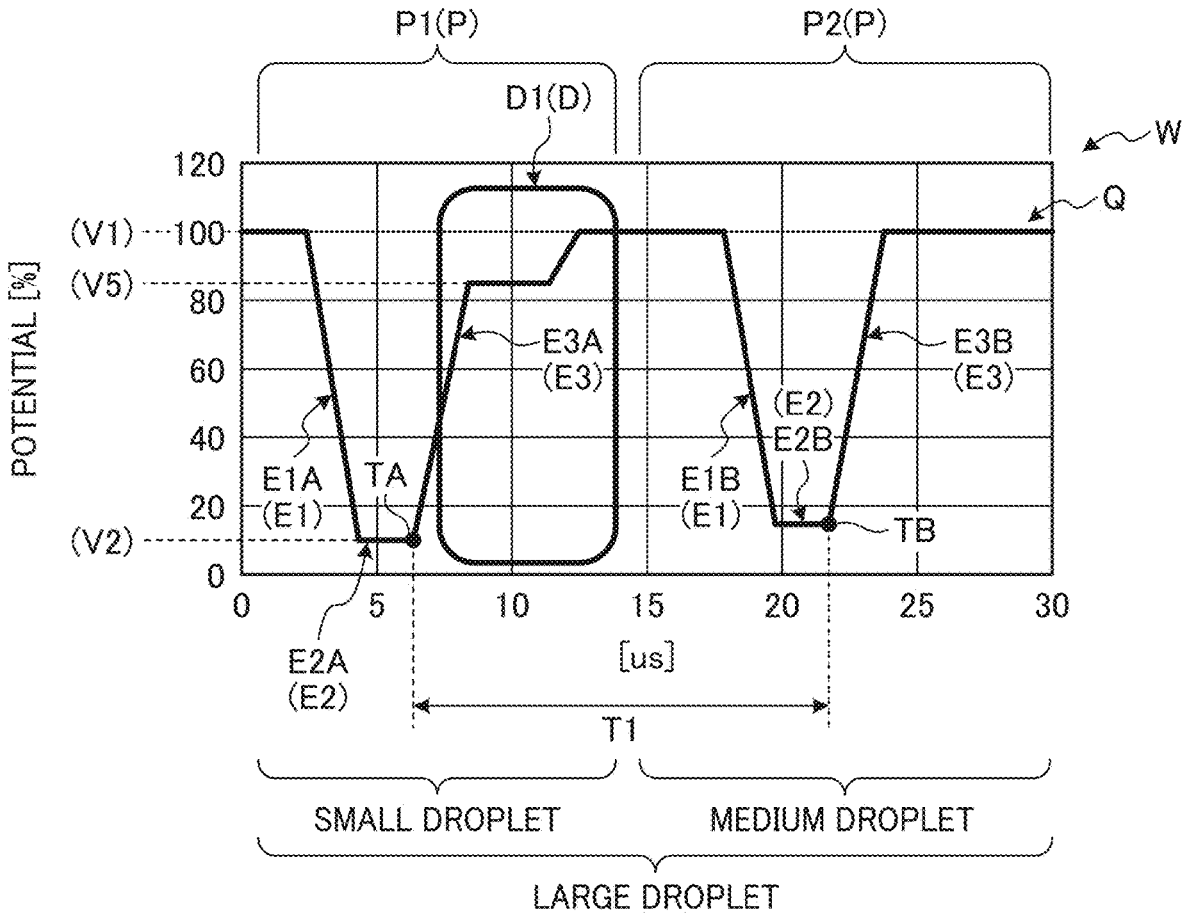
FIG. 8 is a chart illustrating the waveform of a pulse unit of a drive waveform according to an embodiment.

FIG. 8 is a chart illustrating the waveform of a pulse unit Q corresponding to one discharge cycle in a drive waveform W of this embodiment. In FIG. 8, the abscissa axis indicates time, and the ordinate axis indicates potential. In FIG. 8, the ordinate axis indicates the potential in a case where a first potential V1 is illustrated as 100%.

The pulse unit Q is formed with two discharge pulses P. A discharge pulse waveform P means a pulse of a potential at which liquid droplets can be discharged from the nozzles 104.

Specifically, the pulse unit Q is formed with a first discharge pulse waveform P1, and a second discharge pulse waveform P2 after the first discharge pulse waveform P1.

The first discharge pulse waveform P1 and the second discharge pulse waveform P2 each have an expansion waveform element E1 falling from the first potential V1, a maintaining waveform element E2 maintaining a second potential V2 after the falling, and a contraction waveform element E3 rising from the maintaining waveform element E2 toward the first potential V1.

Specifically, the first discharge pulse waveform P1 is formed with an expansion waveform element E1A (a first expansion waveform element), a maintaining waveform element E2A, and a contraction waveform element E3A (a first contraction waveform element). The second discharge pulse waveform P2 is formed with an expansion waveform element E1B (a first expansion waveform element), a maintaining waveform element E2B, and a contraction waveform element E3B (a first contraction waveform element).

The first potential V1 is a reference potential that serves as the reference, as described above. The first potential V1 is a potential at which the piezoelectric elements 121 do not contract (are not driven) (no ink droplets are discharged from the nozzles 104) even when a voltage at the potential is applied to the piezoelectric elements 121.

The second potential V2 is a potential at which pressure is applied to the ink in the liquid chambers 106 by contraction of the piezoelectric elements 121 when a voltage at the potential is applied to the piezoelectric elements 121, and ink droplets are discharged from the nozzles 104.

In other words, a voltage having the waveform indicated by the expansion waveform element E1 is applied to the piezoelectric elements 121, so that pressure is applied to the liquid chambers 106 by driving of the piezoelectric elements 121. A voltage having the waveform indicated by the maintaining waveform element E2 is then applied to the piezoelectric elements 121, so that the pressure to the liquid chambers 106 is maintained. A voltage having the waveform indicated by the contraction waveform element E3 is then applied to the piezoelectric elements 121, so that the pressure applied to the liquid chambers 106 by the driving of the piezoelectric elements 121 is released. As the voltages represented by the waveforms of a discharge pulse waveform P indicated by the expansion waveform element E1, the maintaining waveform element E2, and the contraction waveform element E3 are applied to the piezoelectric elements 121, ink droplets are discharged from the liquid chambers 106.

In this embodiment, the recording head driver 81 (specifically, the analog switch 81A) corresponding to the selection unit selects one of the first discharge pulse waveform P1 and the second discharge pulse waveform P2, or both the first discharge pulse waveform P1 and the second discharge pulse waveform P2 as the discharge pulse waveform(s) P included in the pulse unit Q. By doing so, the recording head driver 81 causes the nozzles 104 to discharge different volumes of ink droplets (liquid). In other words, by selecting the discharge pulse waveform(s) P included in the pulse unit Q, the recording head driver 81 separately selects a plurality of types of ink droplets having different volumes, which is to be discharged from the nozzles 104.

Specifically, as illustrated in FIG. 8, to cause the nozzles 104 to discharge a small droplet, the recording head driver 81 selects the first discharge pulse waveform P1 as the discharge pulse waveform P included in the pulse unit Q. the waveform indicated by the pulse unit Q to be applied to the piezoelectric elements 121 includes the waveform indicated by the first discharge pulse waveform P1 and, subsequent thereto, the waveform element indicated by the maintaining waveform element maintaining the first potential V1.

To cause the nozzles 104 to discharge medium droplets, the recording head driver 81 selects the second discharge pulse waveform P2 as the discharge pulse waveform P included in the pulse unit Q. Accordingly, in this case, the waveform indicated by the pulse unit Q to be applied to the piezoelectric elements 121 is obtained by placing the waveform indicated by the second discharge pulse waveform P2 after the maintaining waveform element maintaining the first potential V1.

Further, to cause the nozzles 104 to discharge large droplets, the recording head driver 81 selects the first discharge pulse waveform P1 and the second discharge pulse waveform P2 as the discharge pulses P included in the pulse unit Q. Accordingly, in this case, the waveform indicated by the pulse unit Q to be applied to the piezoelectric elements 121 is constructed of the first discharge pulse waveform P1 and the second discharge pulse waveform P2 immediately thereafter (adjacent thereto).

A small droplet is liquid having a first volume. A medium droplet is liquid having a second volume that is larger than the first volume. A large droplet is liquid having a third volume that is larger than the second volume.

In a case where no ink droplets are to be discharged, the recording head driver 81 does not select any discharge pulse waveform P included in the pulse unit Q. In this case, the waveform indicated by the pulse unit Q to be applied to the piezoelectric elements 121 is a waveform formed with a maintaining waveform element that maintains the first potential V1.

A voltage having a drive waveform W represented by a plurality of types of pulse units Q with different volumes of liquid to be discharged, such as large droplets, medium droplets, and small droplets, can be applied to the piezoelectric elements 121, to cause the respective nozzles 104 to discharge a plurality of types of ink droplets, such as large droplets, medium droplets, and small droplets. Such a case is now described. In this case, there is the need to adjust the pulse units Q of the drive waveform W so that ink droplets discharged from the respective nozzles 104 will land a paper sheet 22 at the same time.

However, in the pulse unit Q formed with the first discharge pulse waveform P1 and the second discharge pulse waveform P2 for discharging large droplets, residual vibration caused in the liquid chambers 106 by discharge of ink droplets with the first discharge pulse waveform P1 may affect the waveform of the second discharge pulse waveform P2. In this case, there may be an ink droplet discharge defect, or differences in the arrival time at which ink droplets discharged from the nozzles 104 arrive on the paper sheet 22.

For example, if the timing of the second discharge pulse waveform P2 overlaps with the period of residual vibration caused in the liquid chambers 106 by the first discharge pulse waveform P1, resonance with the residual vibration occurs. In this case, due to the resonance between the residual vibration and the second discharge pulse waveform P2, the speed of discharge of ink droplets being discharged with the second discharge pulse waveform P2 may become higher than that in a case where there is no influence of residual vibration.

On the other hand, in a case where the influence of the residual vibration is similar to antiresonance, the speed of discharge of ink droplets being discharged with the second discharge pulse waveform P2 becomes lower than that in a case where there is no influence of residual vibration, and a discharge defect or a merge failure may occur.

Therefore, as illustrated in FIG. 8, the first discharge pulse waveform P1 in the pulse unit Q includes a damping element D in this embodiment. A pulse interval T1 (a first interval) between the first discharge pulse waveform P1 and the second discharge pulse waveform P2 is in the range of N±⅛ (N being an integer of 1 or greater) to N±¼ of the Helmholtz period of the liquid chambers 106. In other words, the pulse interval T1 is in the range of $P_{hlm}\times(N\pm1/8)$ to $P_{hlm}\times(N\pm1/4)$, where $P_{hlm}$ represents the Helmholtz period of the liquid chambers 106.

The damping element D is represented by a waveform that damps vibration of the ink in the liquid chambers 106. In other words, the damping element D is represented by a waveform that damps meniscus vibration of the ink.

For example, as illustrated in FIG. 8, the damping element D is represented by a waveform in which the potential rises stepwise toward the first potential V1, from the start point TA of the rise of the contraction waveform element E3A of the first discharge pulse waveform P1 to the first potential V1 (see a damping element D1). The damping element D1 is an example of the damping element D.

The start point TA is the point at which the contraction waveform element E3A starts rising toward the first potential V1 in the first discharge pulse waveform P1. Specifically, the start point TA is the point of intersection between the maintaining waveform element E2A and the contraction waveform element E3A in the first discharge pulse waveform P1.

FIG. 8 illustrates an example in which the damping element D is represented by a waveform that indicates potential rises in two steps: the potential rises from the start point TA at the second potential V2 toward an intermediate potential V5, and, after maintained at the intermediate potential V5 for a predetermined period of time, the potential rises to the first potential V1. The intermediate potential V5 is a potential between the first potential V1 and the second potential V2. The waveform indicated by the damping element D is not necessarily in two steps, but can be in three or more steps.

Note that the contraction waveform element E3A of the first discharge pulse waveform P1 preferably includes the damping element D1.

This is because the first discharge pulse waveform P1 is the discharge pulse waveform P for discharging small droplets, and the second discharge pulse waveform P2 is the discharge pulse waveform P for discharging the medium droplets. Therefore, if the second potential V2, which is the potential of the respective maintaining waveform elements E2 of the first discharge pulse waveform P1 and the second discharge pulse waveform P2, is adjusted, there is a possibility that an ink droplet discharge defect will occur.

That is, as the contraction waveform element E3A of the first discharge pulse waveform P1 includes the damping element D1, the occurrence of a discharge defect can be prevented when ink droplets are discharged by application of the second discharge pulse waveform P2 placed after the first discharge pulse waveform P1.

Further, as described above, the pulse interval T1 between the first discharge pulse waveform P1 and the second discharge pulse waveform P2 is in the range of N±⅛ (N being an integer of 1 or greater) to N±¼ of the Helmholtz period of the liquid chambers 106. The Helmholtz period is also referred to as an acoustic natural period in some cases.

Specifically, the pulse interval T1 indicates the interval from the start point TA of the rise of the contraction waveform element E3A of the first discharge pulse waveform P1 to the start point TB of the rise of the contraction waveform element E3B of the second discharge pulse waveform P2. In other words, the pulse interval T1 indicates the temporal distance from the start point TA to the start point TB. The start point TB of the rise of the contraction waveform element E3B is the point of intersection between the maintaining waveform element E2B and the contraction waveform element E3B in the second discharge pulse waveform P2.

As the pulse interval T1 between the first discharge pulse waveform P1 and the second discharge pulse waveform P2 is in the range of N±⅛ (N being an integer of 1 or greater) to N±¼ of the Helmholtz period of the liquid chambers 106, the ink droplets to be discharged with the second discharge pulse waveform P2 can be discharged at a timing close to the timing for causing resonance with the residual vibration caused in the liquid chambers 106 by the first discharge pulse waveform P1.

The pulse interval T1 can be in the range of N±⅛ (N being an integer of 1 or greater) to N±¼, but is preferably N±⅛ in particular. Further, N can be an integer of 1 or greater, but is preferably an integer in the range of 1 to 3, and is more preferably N=2.

As the pulse interval T1 is adjusted as described above, it is possible to reduce the possibility of using unintended antiresonance due to variation of the cycles of the individual liquid chambers caused by head variation, as compared with a case where non-resonance is used.

Further, as the contraction waveform element E3A of the first discharge pulse waveform P1 includes the damping element D1, it is possible to reduce the residual vibration to be caused in the liquid chambers 106 by the first discharge pulse waveform P1.

Because of this, the speed of discharge of ink droplets being discharged with the second discharge pulse waveform P2 can be prevented from becoming higher due to the resonance between the residual vibration and the second discharge pulse waveform P2 than that in a case where there is no influence of residual vibration. Thus, it is possible to reduce ink droplet discharge defects and discharge speed variation.

Note that the damping element D can be represented by a waveform that reduces vibration of the ink in the liquid chambers 106. Therefore, the damping element D is not limited to the damping element D1 represented by a waveform in which the potential rises stepwise toward the first potential V1 from the start point TA of the rise of the contraction waveform element E3A of the first discharge pulse waveform P1 as illustrated in FIG. 8.

Figure 9:
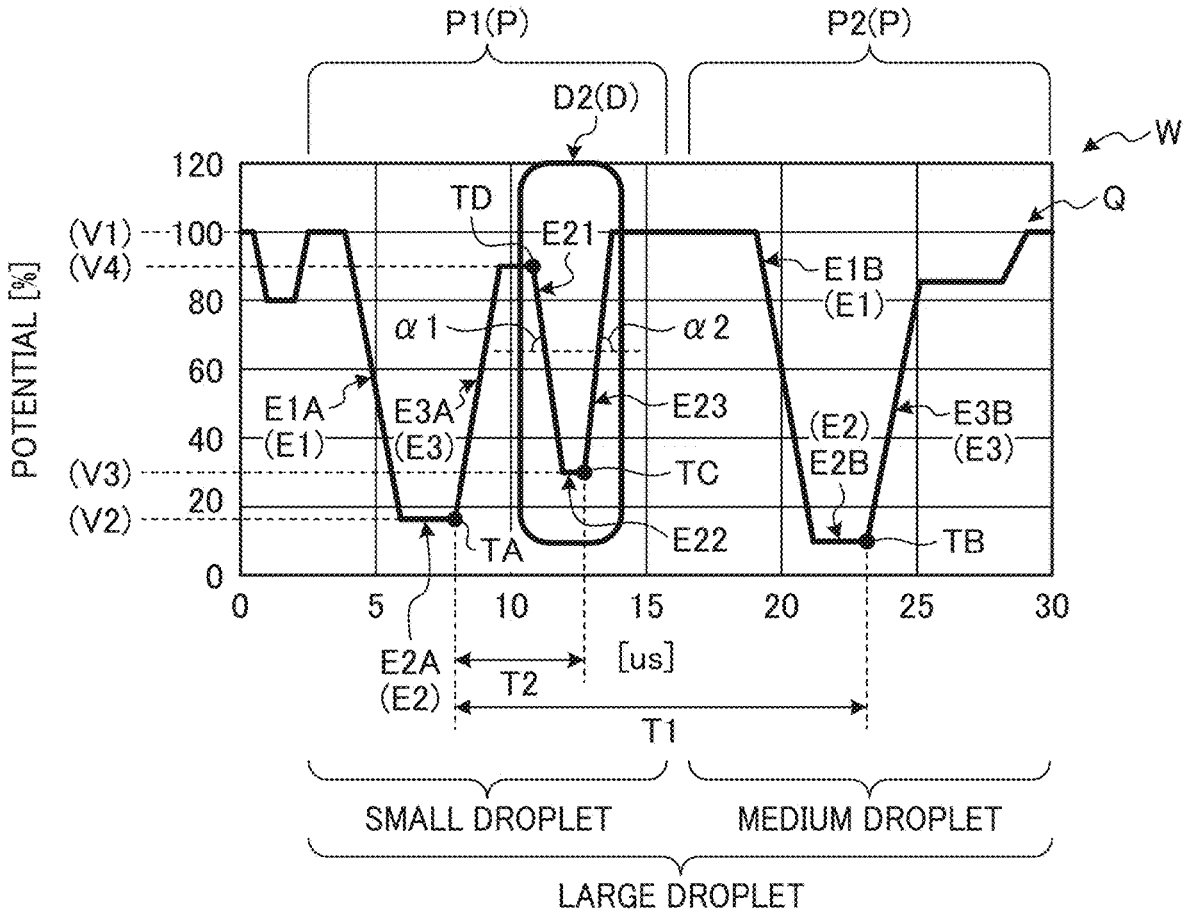
FIG. 9 is a chart illustrating an example of a drive waveform including another damping element according to an embodiment.

FIG. 9 is a schematic view illustrating an example of a drive waveform W including some other damping element D. In FIG. 9, the abscissa axis indicates time, and the ordinate axis indicates potential. In FIG. 9, the ordinate axis indicates the potential in a case where the first potential V1 is illustrated as 100%.

A pulse unit Q of a drive waveform W is formed with a first discharge pulse waveform P1 and a second discharge pulse waveform P2 as in the above described example. However, the damping element D included in the contraction waveform element E3A of the first discharge pulse waveform P1 is a damping element D2 represented by a waveform indicated by an impulse wave, as illustrated in FIG. 9. The damping element D2 is an example of the damping element D.

Specifically, the damping element D2 is formed with a second expansion waveform element E21 that falls toward a third potential V3, and a second contraction waveform element E23 that rises from the second expansion waveform element E21 toward the first potential V1. However, a second maintaining waveform element E22 that maintains the third potential V3 can be placed between the second expansion waveform element E21 and the second contraction waveform element E23. The third potential V3 is a potential between the first potential V1 and the second potential V2.

Further, the slope $\alpha 1$ of the second expansion waveform element E21 in the damping element D2 is steeper than the slope $\alpha 2$ of the second contraction waveform element E23 in the damping element D2.

The potential at the start point TD of the fall of the second expansion waveform element E21 in the damping element D2 is a potential V4 between the first potential V1 and the third potential V3.

In a case where the damping element D2 illustrated in FIG. 9 is used as the damping element D, a start-point interval T2 (a second interval) between the start point TA of the rise of the contraction waveform element E3A of the first discharge pulse waveform P1 and the start point TC of the rise of the second contraction waveform element E23 in the damping element D2 is preferably equal to or shorter than ¾ of the Helmholtz period of the liquid chambers 106.

In other words, the start-point interval T2 indicates the temporal distance from the start point TA of the rise of the contraction waveform element E3A to the start point TC of the rise of the second contraction waveform element E23.

The start-point interval T2 is preferably equal to or shorter than ¾ of the Helmholtz period of the liquid chambers 106, but is preferably in the range of ¾ to ¼, or is more preferably in the range of ½ to ¼.

As described above, the damping element D can be the damping element D2 represented by an impulse waveform formed with the second expansion waveform element E21 and the second contraction waveform element E23. That is, the damping element D can be formed by adjusting the parameters of the impulse waveform.

As described above, in this embodiment, the drive waveform generation circuit 77 generates the drive waveform W in which a pulse unit Q of one discharge cycle is formed with the first discharge pulse waveform P1 including the damping element D, and the second discharge pulse waveform P2 placed after the first discharge pulse waveform P1. The pulse interval T1 between the first discharge pulse waveform P1 and the second discharge pulse waveform P2 is in the range of N±⅛ (N being an integer of 1 or greater) to N±¼ of the Helmholtz period of the liquid chambers 106.

With this arrangement, the liquid discharge apparatus 1 of this embodiment can generate the drive waveform W for discharging ink droplets of a plurality of types with different volumes, such as large droplets, medium droplets, and small droplets, using the pulse unit Q including the first discharge pulse waveform P1 and the second discharge pulse waveform P2, without the use of any micro-vibration pulse that is used in a related art.

In a related art, a combination of three discharge pulses is used as a drive waveform for discharging the respective volumes of ink droplets: large droplets, medium droplets, and small droplets.

Figure 10:
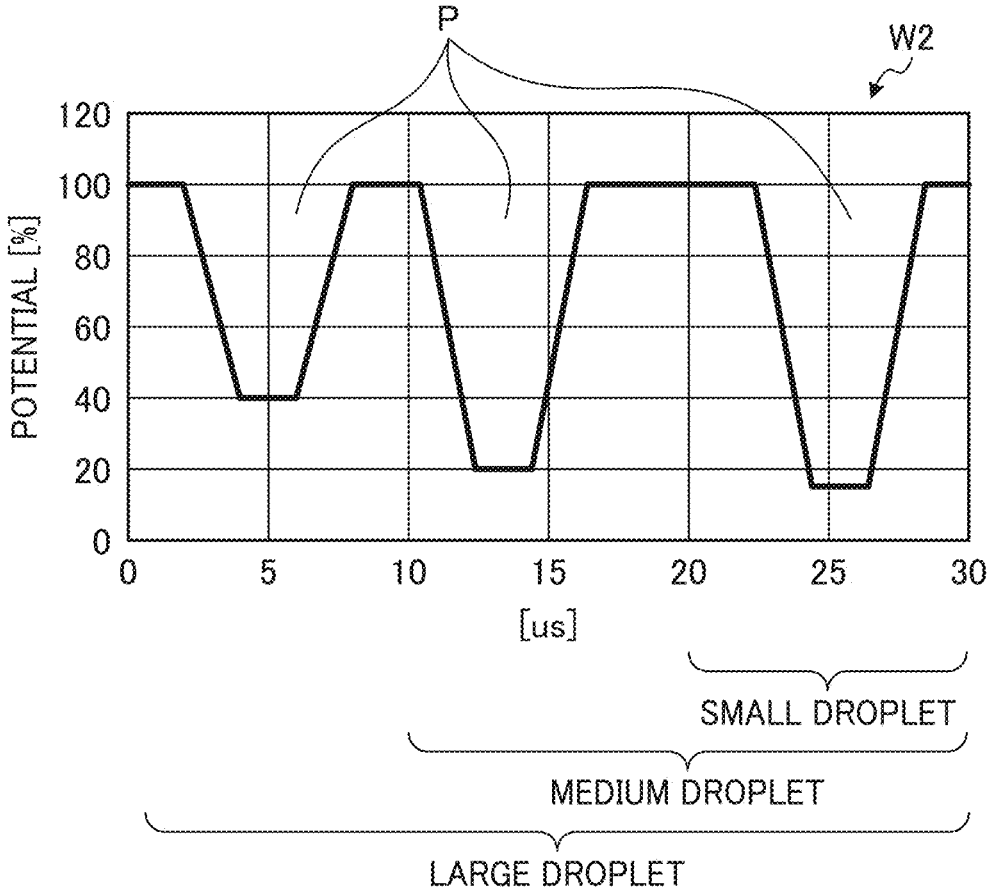
FIG. 10 is a chart for explaining a comparative drive waveform.

FIG. 10 is a chart for explaining a comparative drive waveform W2. As illustrated in FIG. 10, a combination of three discharge pulses P forms a pulse unit for one discharge cycle for discharging the respective volumes of ink droplets: large droplets, medium droplets, and small droplets.

In this embodiment, on the other hand, as illustrated in FIG. 8 and FIG. 9, the two discharge pulses P of the first discharge pulse waveform P1 and the second discharge pulse waveform P2 constitute the pulse unit Q of one discharge cycle for discharging the respective volumes of ink droplets: large droplets, medium droplets, small droplets, and no discharge.

Therefore, while the length of the drive waveform of one discharge cycle in the drive waveform W is about 30 μm in the comparative configuration illustrated in FIG. 10, the waveform length of the pulse unit Q of one discharge cycle in the drive waveform W in this embodiment can be about 25 μm, for example.

Therefore, the liquid discharge apparatus 1 of this embodiment can shorten the length of the drive waveform W.

Further, the contraction waveform element E3 of the first discharge pulse waveform P1 in the pulse unit Q includes the damping element D. As the contraction waveform element E3 of the first discharge pulse waveform P1 includes the damping element D, the first discharge pulse waveform P1, which is the first pulse for forming large droplets, has a damping effect, while the volume of each small droplet to be discharged with the first discharge pulse waveform P1 can be reduced. Thus, it is possible to widen the difference in liquid volume between a small droplet to be discharged with the first discharge pulse waveform P1 and a medium droplet to be discharged with the second discharge pulse waveform P2.

Printing Process to be Performed by the Liquid Discharge Apparatus

Next, an example of procedures in a printing process to be performed by the control device 90 of the liquid discharge apparatus 1 is described.

Figure 11:
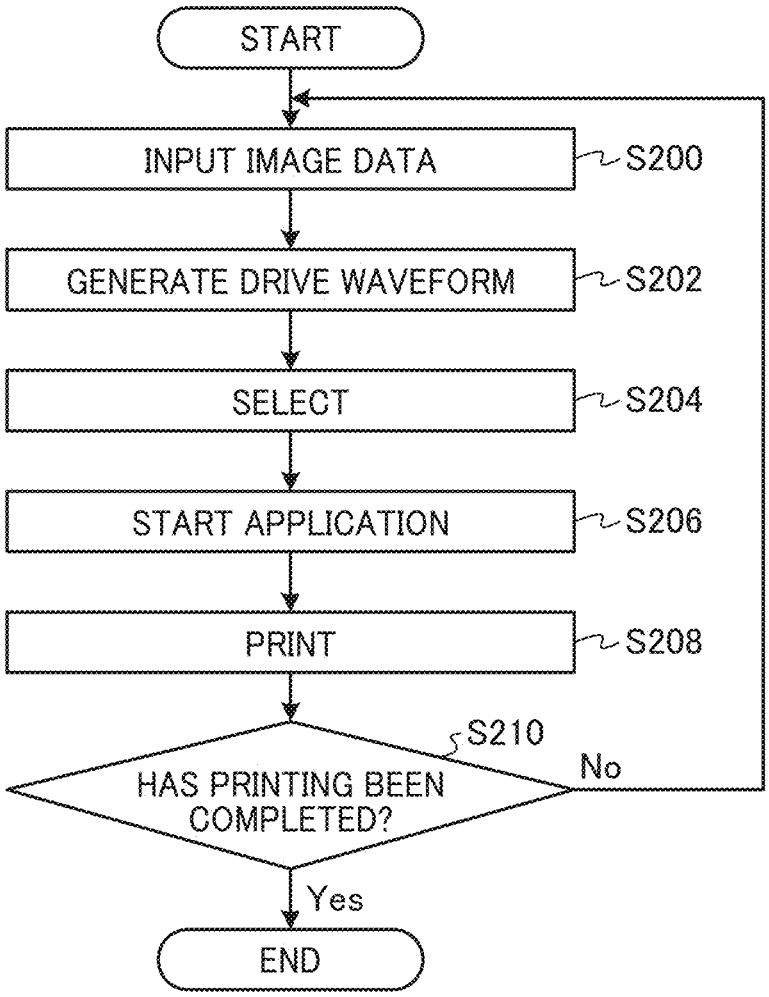
FIG. 11 is a flowchart illustrating an example of a printing procedure according to the embodiment.

FIG. 11 is a flowchart illustrating an example of procedures in a printing process to be performed by the control device 90.

First, the recording head control unit 72F of the control device 90 receives image data from the image processing circuit 61 (step S200).

The drive waveform generation circuit 77 then generates the drive waveform W based on the image data and the like that have been input in step S200, and transmits the drive waveform W to the recording head driver 81 (step S202).

Based on the image data that has been input in step S200, the analog switch 81A of the recording head driver 81 selects, for each pulse unit Q, a discharge pulse waveform P (the first discharge pulse waveform P1 and/or the second discharge pulse waveform P2) included in the drive waveform W supplied from the drive waveform generation circuit 77 (step S204). Through the processing in step S204, the voltage of the drive waveform W indicated by the pulse unit Q formed with the selected discharge pulse waveform(s) P is applied to the piezoelectric elements 121 (step S206). Through this processing, ink droplets having the volume corresponding to the drive waveform W indicated by the pulse unit Q are discharged from the nozzles 104 corresponding to the piezoelectric elements 121, and printing is performed (step S208).

The control device 90 then determines whether printing of all the image data input from the image processing circuit 61 has been completed (step S210). If the printing has been completed (step S210: Yes), the printing operation is ended. If the printing has not been completed yet (step S210: No), the process returns to step S200.

As described above, the control device 90 according to this embodiment includes the drive waveform generation circuit 77 (the drive waveform generation unit) and the recording head driver 81 (the selection unit). The drive waveform generation circuit 77 generates the drive waveform W including a plurality of discharge pulses P in the pulse unit Q of one discharge cycle, which is to be applied to the piezoelectric elements 121 (electromechanical transducer elements) to change the pressure in the liquid chambers 106 communicating with the nozzles 104 that discharge liquid (ink droplets). The recording head driver 81 (the selection unit) selects a discharge pulse waveform P included in the pulse unit Q in accordance with the volume of the liquid to be discharged. The pulse unit Q is formed with the first discharge pulse waveform P1 including the damping element D that damps vibration of ink (liquid), and the second discharge pulse waveform P2 placed after the first discharge pulse waveform P1. The pulse interval T1 between the first discharge pulse waveform P1 and the second discharge pulse waveform P2 is in the range of N±⅛ (N being an integer of 1 or greater) to N±¼ of the Helmholtz period of the liquid chambers 106. The recording head driver 81 (the selection unit) selects the first discharge pulse waveform P1, the second discharge pulse waveform P2, or the first discharge pulse waveform P1 and the second discharge pulse waveform P2 as the discharge pulse waveform(s) P included in the pulse unit Q. By doing so, the recording head driver 81 causes the nozzles 104 to discharge different volumes of ink droplets (liquid).

As described above, in the control device 90 according to this embodiment, the first discharge pulse waveform P1, the second discharge pulse waveform P2, or the first discharge pulse waveform P1 and the second discharge pulse waveform P2 in the pulse unit Q formed with the first discharge pulse waveform P1 including the damping element D and the second discharge pulse waveform P2 are selected, to cause the nozzles 104 to discharge different volumes of liquid.

Thus, the length of the drive waveform W can be made shorter than that in a related art by which a micro-vibration pulse is separately added, and that in a related art by which a combination of three discharge pulses is used to discharge different volumes of liquid.

Accordingly, the control device 90 of this embodiment can shorten the length of the drive waveform W.

Further, as the control device 90 of this embodiment can shorten the length of the drive waveform W, high-frequency driving of the recording head 12 with the drive waveform W of a short wavelength can be performed.

The control device 90 according to this embodiment can also reduce differences in the landing position between liquid droplets with different volumes to be discharged in conjunction with the discharge speed during the time from the discharge to the arrival on a paper sheet 22, and the decrease in the roundness of ink droplets that have arrived on the paper sheet 22 due to a large droplet merge failure.

Further, the first discharge pulse waveform P1 and the second discharge pulse waveform P2 each have the expansion waveform element E1 falling from the first potential V1, the maintaining waveform element E2 maintaining the second potential V2 after the falling, and the contraction waveform element E3 rising from the maintaining waveform element E2 toward the first potential V1. The contraction waveform element E3 of the first discharge pulse waveform P1 includes the damping element D.

The pulse interval T1 indicates the interval from the start point TA of the rise of the contraction waveform element E3A of the first discharge pulse waveform P1 to the start point TB of the rise of the contraction waveform element E3B of the second discharge pulse waveform P2.

The damping element D1 is represented by a waveform in which the potential rises stepwise toward the first potential V1 from the start point TA of the rise of the contraction waveform element E3A of the first discharge pulse waveform P1.

Further, the damping element D2 is formed with the second expansion waveform element E21 that falls toward the third potential V3 between the first potential V1 and the second potential V2, and the second contraction waveform element E23 that rises from the second expansion waveform element E21 toward the first potential V1, and the slope $\alpha 1$ of the second expansion waveform element E21 is steeper than the slope $\alpha 2$ of the second contraction waveform element E23.

The start-point interval T2 between the start point TA of the rise of the contraction waveform element E3A of the first discharge pulse waveform P1 and the start point TC of the rise of the second contraction waveform element E23 in the damping element D2 is preferably equal to or shorter than ¾ of the Helmholtz period of the liquid chambers 106.

The recording head driver 81 (the selection unit) selects the first discharge pulse waveform P1 to cause the nozzles 104 to discharge the first volume of liquid, selects the second discharge pulse waveform P2 to cause the nozzles 104 to discharge the second volume of liquid that is larger than the first volume, and selects the first discharge pulse waveform P1 and the second discharge pulse waveform P2 to cause the nozzles 104 to discharge the third volume of liquid that is larger than the second volume.

The liquid discharge apparatus 1 of this embodiment includes: the nozzles 104 that discharge liquid (ink droplets); the piezoelectric elements 121 (electromechanical transducer elements) that change the pressure in the liquid chambers 106 communicating with the nozzles 104; the drive waveform generation circuit 77 (the drive waveform generation unit) that generates the drive waveform W including a plurality of discharge pulses P in the pulse unit Q of one discharge cycle to be applied to the piezoelectric elements 121; and the recording head driver 81 (the selection unit) that selects a discharge pulse waveform P included in the pulse unit Q in accordance with the volume of liquid to be discharged.

Note that the recording head 12 in this embodiment is a functional component that discharges/ejects liquid from the nozzles 104.

Liquid to be discharged from the nozzles 104 of the head is not limited to a particular liquid as long as the liquid has a viscosity or surface tension to be discharged from the head. However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment liquid, a liquid for forming components of electronic element or light-emitting element or a resist pattern of electronic circuit, or a material solution for three-dimensional fabrication.

The piezoelectric elements 121 are an example of electromechanical transducer elements as described above. The piezoelectric element 121 is an energy generation source for liquid discharge. Examples of the energy generation source include a piezoelectric actuator (a laminated piezoelectric element or a thin-film piezoelectric element), a thermal actuator that employs an electrothermal transducer element, such as a heat element, and an electrostatic actuator including a diaphragm and opposed electrodes.

The liquid discharge apparatus 1 can be any apparatus that includes the recording head 12 and drives the recording head 12 to discharge liquid. The liquid discharge apparatus 1 includes, in addition to apparatuses to discharge liquid to materials to which the liquid can adhere, apparatuses to discharge the liquid into gas (air) or liquid.

The liquid discharge apparatus 1 can also include devices to feed, convey, and discharge the material onto which liquid adheres. The liquid discharge apparatus can further include a pretreatment apparatus to apply treatment liquid to the material before liquid is discharged onto the material and a post-treatment apparatus to apply treatment liquid to the material after liquid is discharged onto the material.

The liquid discharge apparatus 1 is not limited to the configuration to apply liquid droplets onto the paper sheet 22, to form an image. For example, the liquid discharge apparatus 1 can be an inkjet three-dimensional fabricating apparatus. In this case, for example, the liquid discharge apparatus 1 is a three-dimensional fabricating apparatus (a solid fabricating apparatus) that discharges a fabricating liquid onto layers of powder, in order to fabricate a three-dimensional object (three-dimensional fabricated object). Moreover, the liquid discharge apparatus 1 can be a three-dimensional fabricating apparatus that discharges a fabricating liquid for fabricating a three-dimensional modeled object and forms the modeled object by discharging the fabricating liquid so as to be laminated.

The liquid discharge apparatus 1 is not limited to an apparatus to discharge liquid to visualize meaningful images, such as letters or figures. For example, the liquid discharge apparatus can be an apparatus to form meaningless images, such as meaningless patterns, or fabricate meaningless three-dimensional images.

The "liquid adherable material" is a material on which a liquid can be attached at least temporarily, and indicates a material on which a liquid is adhered and fixed, adhered and permeated, and the like. Examples of "material to which liquid can adhere" include paper sheets, recording media such as recording sheet, recording sheets, film, and cloth; electronic components such as electronic substrates and piezoelectric elements; and media such as powder layers, organ models, and testing cells. The term "material to which liquid can adhere" includes any material to which liquid adheres, unless particularly limited.

Examples of the "material on which liquid can be adhered" include any materials on which liquid can be adhered even temporarily, such as paper, thread, fiber, fabric, leather, metal, plastic, glass, wood, and ceramic.

The liquid discharge apparatus 1 can be an apparatus to relatively move the recording head 12 and a material on which liquid can be adhered. However, the liquid discharge apparatus is not limited to such an apparatus. As a specific example, the liquid discharge apparatus 1 can be a serial type apparatus that moves the recording head 12, a line type apparatus that does not move the recording head 12, or the like.

Examples of the liquid discharge apparatus 1 further include a treatment liquid coating apparatus to discharge a treatment liquid to the paper sheet 22 to coat, with the treatment liquid, a sheet surface to reform the sheet surface and an injection granulation apparatus in which a composition liquid including raw materials dispersed in a solution is discharged through nozzles to granulate fine particles of the raw materials.

Although some embodiments of the present disclosure have been described above, the above-described embodiments are presented as examples and are not intended to limit the scope of the present invention. The above-described embodiments can be implemented in other various forms, and various omissions, replacements, and changes can be made without departing from the scope of the invention. These embodiments and modifications thereof are included in the scope and gist of the invention, and are included in the invention described in the claims and the equivalent scope thereof.

The operation by each apparatus or terminal constituting the liquid discharge apparatus 1 according to the embodiments described above can be implemented in any convenient form, for example using hardware, software, or a mixture of hardware and software.

For executing a process or processes using software, a program storing a processing sequence installed in a memory of a computer embedded in a dedicated hardware is executed. Alternatively, such program can be installed for execution in a memory of a general purpose computer that can perform various processes.

The program can be stored in advance in a hard disc or a read only memory (ROM) as a recording medium. Alternatively, the program can be stored temporarily or permanently stored in a removable recording medium. Such removable recording medium can be provided as a packaged software. Such removable recording medium can be implemented by various types of a recording medium such as a magnetic disk or a semiconductor memory.

The program can be installed in a computer from the removable recording medium as described above. Alternatively, the program can be download from a website to the computer via a wireless communications network. Alternatively, the program may be transferred to the computer via a wired communications network.

Each device constituting the liquid discharge apparatus 1 according to the embodiments described above may execute each step of the operation according to the exemplary embodiments described above sequentially, concurrently or individually depending on performance of the apparatus or terminal or as needed. For example, according to the processing capability of the device that executes the processing or depending on the necessity, the device can be configured to execute the processing in parallel or individually.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and comparative circuit components arranged to perform the recited functions.

What is claimed is:

1. A control device comprising:

circuitry configured to:

generate a drive waveform to be applied to an electromechanical transducer element configured to change a pressure in a liquid chamber communicating with a nozzle configured to discharge a liquid, the drive waveform including, in a pulse unit of one discharge cycle:

a first discharge pulse waveform including a damping element configured to damp a vibration of the liquid; and a second discharge pulse waveform subsequent to the first discharge pulse waveform, the second discharge pulse waveform being at a pulse interval from the first discharge pulse waveform, the pulse interval in a range of $P_{hlm}\times(N\pm 1/8)$ to $P_{hlm}\times(N\pm 1/4)$, where $P_{hlm}$ represents a Helmholtz period of the liquid chamber and N represents an integer of 1 or greater; and select at least one of the first discharge pulse waveform and the second discharge pulse waveform in the pulse unit in accordance with a volume of the liquid to be discharged, to cause the nozzle to discharge different volumes of the liquid.

2. The control device according to claim 1, wherein each of the first discharge pulse waveform and the second discharge pulse waveform includes:

an expansion waveform element falling from a first potential to a second potential lower than the first potential;

a maintaining waveform element maintaining the second potential; and a contraction waveform element rising from the maintaining waveform element toward the first potential, and wherein the contraction waveform element of the first discharge pulse waveform includes the damping element.

3. The control device according to claim 2, wherein the pulse interval is an interval from a rise start point of the contraction waveform element of the first discharge pulse waveform to a rise start point of the contraction waveform element of the second discharge pulse waveform.

4. The control device according to claim 2, wherein the damping element is a waveform in which a potential rises stepwise from a rise start point of the contraction waveform element of the first discharge pulse waveform toward the first potential.

5. The control device according to claim 2, wherein the expansion waveform element of each of the first discharge pulse waveform and the second discharge pulse waveform is referred to as a first expansion waveform element, wherein the contraction waveform element of each of the first discharge pulse waveform and the second discharge pulse waveform is referred to as a first contraction waveform element, wherein the damping element includes:

a second expansion waveform element falling toward a third potential between the first potential and the second potential; and a second contraction waveform element rising from the second expansion waveform element toward the first potential, and wherein a slope of the second expansion waveform element is steeper than a slope of the second contraction waveform element.

6. The control device according to claim 5, wherein a start-point interval between a rise start point of the contraction waveform element of the first discharge pulse waveform and a rise start point of the second contraction waveform element in the damping element is not longer than ¾ of the Helmholtz period of the liquid chamber.

7. The control device according to claim 1, wherein the circuitry is configured to:

select the first discharge pulse waveform to cause the nozzle to discharge a first volume of the liquid, select the second discharge pulse waveform to cause the nozzle to discharge a second volume of the liquid, the second volume being larger than the first volume, and select the first discharge pulse waveform and the second discharge pulse waveform to cause the nozzle to discharge a third volume of the liquid, the third volume being larger than the second volume.

8. A liquid discharge apparatus comprising:

a nozzle configured to discharge a liquid;

a liquid chamber communicating with the nozzle;

an electromechanical transducer element configured to change a pressure in the liquid chamber; and circuitry configured to:

generate a drive waveform to be applied to the electromechanical transducer element, the drive waveform including, in a pulse unit of one discharge cycle:

a first discharge pulse waveform including a damping element configured to damp a vibration of the liquid; and a second discharge pulse waveform subsequent to the first discharge pulse waveform, the second discharge pulse waveform at a pulse interval from the first discharge pulse waveform, the pulse interval in a range of $P_{hlm}\times(N\pm 1/8)$ to $P_{hlm}\times(N\pm 1/4)$, where $P_{hlm}$ represents a Helmholtz period of the liquid chamber and N represents an integer of 1 or greater; and select at least one of the first discharge pulse waveform and the second discharge pulse waveform in the pulse unit in accordance with a volume of the liquid to be discharged, to cause the nozzle to discharge different volumes of the liquid.

9. The liquid discharge apparatus of claim 8, wherein the first discharge pulse has first potential and a second potential, the first potential being higher than the second potential, and the damping element has a third potential and a fourth potential, the third and fourth potential being higher than the second potential and lower than the first potential.

10. A control device comprising:

circuitry configured to:

generate a drive waveform to be applied to an electromechanical transducer element configured to change a pressure in a liquid chamber communicating with a nozzle configured to discharge a liquid, the drive waveform including, in a pulse unit of one discharge cycle:

a first discharge pulse waveform including a damping element configured to damp a vibration of the liquid, the first discharge pulse has a first potential and a second potential, the first potential being higher than the second potential, and the damping element has a third potential and a fourth potential, the third and fourth potential being higher than the second potential and lower than the first potential, and a second discharge pulse waveform subsequent to the first discharge pulse waveform, the second discharge pulse waveform being at a pulse interval from the first discharge pulse waveform, the pulse interval in a range of $P_{hlm}\times(N\pm 1/8)$ to $P_{hlm}\times(N\pm 1/4)$, where $P_{hlm}$ represents a Helmholtz period of the liquid chamber and N represents an integer of 1 or greater; and select at least one of the first discharge pulse waveform and the second discharge pulse waveform in the pulse unit in accordance with a volume of the liquid to be discharged, to cause the nozzle to discharge different volumes of the liquid.

11. The control device according to claim 10, wherein each of the first discharge pulse waveform and the second discharge pulse waveform includes:

an expansion waveform element falling from the first potential to the second potential;

a maintaining waveform element maintaining the second potential; and a contraction waveform element rising from the maintaining waveform element toward the first potential, and wherein the contraction waveform element of the first discharge pulse waveform includes the damping element.

12. The control device according to claim 11, wherein the pulse interval is an interval from a rise start point of the contraction waveform element of the first discharge pulse waveform to a rise start point of the contraction waveform element of the second discharge pulse waveform.

13. The control device according to claim 11, wherein the damping element is a waveform in which a potential rises stepwise from a rise start point of the contraction waveform element of the first discharge pulse waveform toward the first potential.

14. The control device according to claim 11, wherein the expansion waveform element of each of the first discharge pulse waveform and the second discharge pulse waveform is referred to as a first expansion waveform element, wherein the contraction waveform element of each of the first discharge pulse waveform and the second discharge pulse waveform is referred to as a first contraction waveform element, wherein the damping element includes:

a second expansion waveform element falling toward the third potential between the first potential and the second potential; and a second contraction waveform element rising from the second expansion waveform element toward the first potential, and wherein a slope of the second expansion waveform element is steeper than a slope of the second contraction waveform element.

15. The control device according to claim 14, wherein a start-point interval between a rise start point of the contraction waveform element of the first discharge pulse waveform and a rise start point of the second contraction waveform element in the damping element is not longer than 3/4 of the Helmholtz period of the liquid chamber.

16. The control device according to claim 10, wherein the circuitry is configured to:

select the first discharge pulse waveform to cause the nozzle to discharge a first volume of the liquid, select the second discharge pulse waveform to cause the nozzle to discharge a second volume of the liquid, the second volume being larger than the first volume, and select the first discharge pulse waveform and the second discharge pulse waveform to cause the nozzle to discharge a third volume of the liquid, the third volume being larger than the second volume.

* * * * *